US008013503B2

(12) United States Patent
Kameda et al.

(10) Patent No.: US 8,013,503 B2
(45) Date of Patent: Sep. 6, 2011

(54) SPARK PLUG FOR INTERNAL COMBUSTION ENGINE HAVING GROUND ELECTRODE WITH THICK, THIN AND STEPPED PORTION AND METHOD FOR PRODUCING THE SPARK PLUG

(75) Inventors: Hiroyuki Kameda, Aichi (JP); Katsutoshi Nakayama, Aichi (JP); Satoshi Nagasawa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 308 days.

(21) Appl. No.: 12/274,423

(22) Filed: Nov. 20, 2008

(65) Prior Publication Data

US 2009/0134764 A1 May 28, 2009

(30) Foreign Application Priority Data

Nov. 20, 2007 (JP) ..... 2007-300824
Dec. 28, 2007 (JP) ..... 2007-338716

(51) Int. Cl.
*H01T 13/20* (2006.01)
*H01T 21/02* (2006.01)

(52) U.S. Cl. ..... 313/141; 313/118; 313/142; 313/143; 123/169 EL; 123/169 R; 445/7

(58) Field of Classification Search ..... 313/141
See application file for complete search history.

(56) References Cited

U.S. PATENT DOCUMENTS

| | | | | |
|---|---|---|---|---|
| 4,700,103 | A | 10/1987 | Yamaguchi et al. | |
| 5,488,262 | A | 1/1996 | Takamura | |
| 6,265,814 | B1 * | 7/2001 | Yoshinaga et al. | 313/141 |
| 6,720,716 | B2 | 4/2004 | Shibata et al. | |
| 6,724,132 | B2 | 4/2004 | Kanao | |
| 6,798,124 | B2 * | 9/2004 | Hiramatsu | 313/141 |
| 7,084,558 | B2 | 8/2006 | Teramura et al. | |
| 7,321,187 | B2 | 1/2008 | Teramura et al. | |
| 2002/0021066 | A1 | 2/2002 | Kanao | |
| 2002/0093277 | A1 | 7/2002 | Hiramatsu | |
| 2004/0041506 | A1 | 3/2004 | Teramura et al. | |
| 2006/0238092 | A1 | 10/2006 | Teramura et al. | |
| 2009/0140624 | A1 * | 6/2009 | Kameda et al. | 313/141 |

FOREIGN PATENT DOCUMENTS

| | | | |
|---|---|---|---|
| CN | 1472854 | A | 2/2004 |
| EP | 1 376 791 | A1 | 1/2004 |
| JP | 61-45583 | A | 3/1986 |
| JP | 5-166577 | A | 7/1993 |
| JP | 5-198348 | A | 8/1993 |
| JP | 2002-83662 | A | 3/2002 |
| JP | 2002-289321 | A | 10/2002 |
| JP | 2002-324650 | A | 11/2002 |
| JP | 2004-127916 | A | 4/2004 |
| WO | 2007/149862 | A2 | 12/2007 |

* cited by examiner

*Primary Examiner* — Sikha Roy
(74) *Attorney, Agent, or Firm* — Sughrue Mion, PLLC

(57) ABSTRACT

A spark plug including: a ground electrode including a thick portion provided on a base end side, a thin portion provided on a distal end side, and a stepped portion provided on an inner peripheral surface between the thick portion and the thin portion; a noble metal tip partially embedded in an inner peripheral surface of the thin portion; and a bulge portion provided on the inner peripheral surface of the thin portion between the stepped portion and the noble metal tip. When viewed from a side surface of the ground electrode, a relationship [a protruding height of the noble metal tip from the inner peripheral surface of the thin portion]≧[a protruding height of the bulge portion from the inner peripheral surface of the thin portion].

14 Claims, 12 Drawing Sheets

SPARK PLUG FOR INTERNAL COMBUSTION ENGINE HAVING GROUND ELECTRODE WITH THICK, THIN AND STEPPED PORTION AND METHOD FOR PRODUCING THE SPARK PLUG

BACKGROUND OF THE INVENTION

1. Field of the Invention

The present invention relates to a spark plug for an internal combustion engine and a method for producing the spark plug.

2. Description of the Related Art

A spark plug used for an internal combustion engine, such as an automobile engine, includes a center electrode extended in the direction of an axis line, an insulator disposed radial outside the center electrode, a cylindrical metal shell disposed radial outside the insulator, and a ground electrode having a base end portion joined to a leading end surface of the metal shell. The ground electrode has a substantially rectangular shape in cross section, and the inner side surface of the distal end portion thereof is bent to face the leading end portion of the center electrode. As a result, a spark discharge gap is defined between the leading end portion of the center electrode and the distal end portion of the ground electrode.

In recent years, tips (noble metal tips) containing a noble metal alloy are joined to the leading end portion of the center electrode and the distal end portion of the ground electrode, respectively, for improving spark wear resistance. Additionally, in order to improve ignitability or spark propagation capability, a prism-shaped noble metal tip is welded to the ground electrode to protrude from a distal end surface of the ground electrode located on the axis-line side toward the axis line, and a spark discharge is performed between the noble metal tip and the outer periphery of the leading end portion of the center electrode (outer periphery of the noble metal tip for a center electrode) in a direction perpendicular to the direction of the axis line (see JP-A-61-45583, for example).

Such spark plug is generally produced by welding a noble metal tip for a ground electrode to a predetermined portion of the leading end portion of the straight rod-shaped ground electrode, and thereafter bending the ground electrode.

However, as described above, in a spark plug in which a spark discharge is performed in the direction perpendicular to the direction of the axis line, the bent portion of the ground electrode becomes tightened. In detail, in order to perform a spark discharge in the direction of the axis line, the ground electrode is formed so that its distal end portion reaches the axis line, and the ground electrode can easily be bent. In other words, it is not very difficult to make the distal end portion of the ground electrode straight. On the other hand, in order to perform a spark discharge in the direction perpendicular to the direction of the axis line, the distal end surface of the ground electrode is not allowed to reach the axis line. Therefore, a bent shape may still remains at the distal end portion of the ground electrode (i.e., it becomes difficult to make the distal end portion straight), or stresses caused by the bending will remain. If the spark plug is used while the residual stresses remains at the distal end portion of the ground electrode, the stress applied to the welded portion between the noble metal tip and the ground electrode may increase due to repetition of the cooling-heating cycle, and this may deteriorate a peel resistance of the noble metal tip.

Particularly, there is a need for a smaller diameter of spark plugs in recent years, and the diameter of the metal shell is also smaller, which may remarkably cause the above problem. In addition, when the diameter of the metal shell is small, not only in a type in which a spark discharge is performed in the direction perpendicular to the direction of the axis line, the above problem is also found in a type in which a spark discharge is performed in the direction of the axis line.

On the other hand, by increasing the curvature of the bent portion of the ground electrode (reducing the radius of curvature), the above problem is solved to some extent. However, in this case, strength at the bent portion cannot be secured, and another problem such as breakage of the bent portion may occur.

SUMMARY OF THE INVENTION

The present invention was made in consideration of the above circumstances, and an object thereof is to provide a spark plug for an internal combustion engine capable of preventing deterioration in peel resistance, etc., of a noble metal tip due to the residual stresses caused by bending of a ground electrode. Particularly, the present invention has an object to prevent deterioration in the peel resistance upon considering a bulge portion which is formed to protrude by embedding a noble metal tip in a ground electrode and contains a same metal component as that of the ground electrode.

A description will be hereinafter given of each aspect categorized to be suitable to solve the above-mentioned problems. The operations and effects unique to the corresponding aspects are added if necessary.

In a first aspect, the present invention provides a spark plug for an internal combustion engine, comprising: a rod-shaped center electrode extending in a direction of an axis line; a substantially cylindrical insulator disposed on an outer periphery of the center electrode; a cylindrical metal shell disposed on an outer periphery of the insulator; a ground electrode having a base end joined to a leading end portion of the metal shell in the direction of the axis line and a distal end portion bent toward the axis line, said ground electrode comprising: a thick portion provided on a base end side; a thin portion provided on a distal end side; and a stepped portion provided on an inner peripheral surface between the thick portion and the thin portion; a noble metal tip joined to and partially embedded in an inner peripheral surface of the thin portion, the noble metal tip being disposed to form a gap between the same and the leading end portion of the center electrode; and a bulge portion provided on the inner peripheral surface of the thin portion between the stepped portion and the noble metal tip and containing a same metal component contained in the ground electrode, wherein, when viewed from a side surface of the ground electrode, a following relationship is satisfied: [a protruding height of the noble metal tip from the inner peripheral surface of the thin portion]≧[a protruding height of the bulge portion from the inner peripheral surface of the thin portion].

According to the first aspect, the ground electrode is disposed to have the distal end bent toward the axis line. Therefore, at the distal end portion of the ground electrode, in particular, at a position apart from the center (line) of the ground electrode in the thickness direction, the stresses (for example, compressive stresses) caused by bending may remain.

In this regard, in the first aspect, the ground electrode includes a thick portion provided on the base end side, a thin portion provided on the distal end side, and a stepped portion provided on the inner peripheral surface between the thick portion and the thin portion. In addition, a noble metal tip is joined to and partially embedded in the inner peripheral surface of the thin portion. Therefore, in comparison with the case where the stepped portion and the thin portion are not provided, the joined surface of the noble metal tip can be made closer to the center of the ground electrode in the thickness direction. In other words, the joined portion of the noble metal tip can be positioned at a portion where the residual stresses caused by bending are comparatively small. Therefore, even when the plug is used for a long period of time, deterioration in peel resistance due to the residual stresses can be prevented. If the thin portion is excessively long, the effects by providing the thick portion and the thin portion may be reduced. In such a perspective, the length from the distal end of the ground electrode to the stepped portion (length of the thin portion) may be preferably 1.2 (mm) or less.

In the first aspect, by embedding a part of the noble metal tip, a portion containing the same metal components as those of the ground electrode is formed so as to bulge. The relationship of [the protruding height of the noble metal tip from the inner peripheral surface of the thin portion]≧[the protruding height of the bulge portion from the inner peripheral surface of the thin portion] is satisfied where the bulge portion corresponds to the portion formed so as to bulge. In other words, when viewed from a side surface of the ground electrode, if a horizontal line is drawn from the end portion on the base end side of the noble metal tip to the stepped portion, the bulge portion does not protrude from the horizontal line. Therefore, when the ground electrode is bent, a reactive force of this bending is hardly applied to the noble metal tip from the bulge portion. Therefore, deterioration in peel resistance of the noble metal tip due to the presence of the bulge portion can be prevented.

Next, a second aspect is conceived in view of further prevention of deterioration in the peel resistance due to the presence of the bulge portion.

In the second aspect, the present invention provides the spark plug according to the first aspect, wherein when viewed from the side surface of the ground electrode, a space is formed between the stepped portion and the bulge portion.

According to the second aspect, the space between the stepped portion and the bulge portion is formed. When the ground electrode is bent, the stresses to be applied to the bulge portion from the stepped portion are remarkably reduced. Therefore, the stresses to be applied to the noble metal tip from the bulge portion are also reduced, and as a result, deterioration in the peel resistance of the noble metal tip due to the presence of the bulge portion can be further prevented.

Next, a third aspect of the invention is conceived in view of forming the bulge portion of the first and second aspects 1 and 2.

In the third aspect, the present invention provides the spark plug according to the first or second aspect, wherein when viewed from the side surface of the ground electrode, the distance between an end portion of the noble metal tip located on the stepped portion side and the stepped portion in a direction perpendicular to the direction of the axis line is 0.1 mm or more.

According to the third aspect, the distance between the end portion on the stepped portion side of the noble metal tip and the stepped portion in the direction perpendicular to the direction of the axis line, that is, in the horizontal direction is 0.1 mm or more. Therefore, the protruding height of the bulge portion formed to bulge by embedding the noble metal tip can be made small, and further, it may be unnecessary to form the bulge portion up to the side of the stepped portion. As a result, the spark plug for an internal combustion engine of the first or second aspect can be reliably obtained without great difficulty.

However, if the length of the thin portion is only increased, it may result in excessive bending stresses. Accordingly, a fourth aspect may be further preferable.

In the fourth aspect, the present invention provides the spark plug according to any of the first to third aspects, wherein when viewed from the side surface of the ground electrode, the stepped portion has a straight portion, and wherein a relationship $M1 \leqq 0.75\ B$ is satisfied where: a boundary point γ1 is an intersection of an extension line of the straight portion and an extension line of the inner peripheral surface of the thick portion, M1 (mm) is a distance between a distal end surface of the ground electrode and the boundary point γ1 in a direction perpendicular to the direction of the axis line, and B (mm) is a distance between the distal end surface of the ground electrode and the base end of the inner peripheral surface of the ground electrode in a direction perpendicular to the direction of the axis line.

According to the fourth aspect, the length of the thin portion is not very long and satisfies $M1 \leqq 0.75\ B$, so that excessive bending stresses on the bent portion of the ground electrode can be avoided. Therefore, deterioration in breaking strength at the bent portion of the ground electrode can be suppressed.

In addition, a smaller diameter of spark plugs has been demanded in recent years, and the diameter of the metal shell tends to be smaller. In this regard, in a following fifth aspect, the operation and effect described above are more effectively obtained.

In the fifth aspect, the invention provides the spark plug according to any of the first to fourth aspects, wherein $B/A \leqq 2.5$ is satisfied where, when viewed from the side surface of the ground electrode, A (mm) is a thickness of the thick portion of the ground electrode, and B (mm) is a distance between the distal end surface of the ground electrode and the base end of the inner peripheral surface of the ground electrode in a direction perpendicular to the direction of the axis line.

Thus, in the fifth aspect, $B/A \leqq 2.5$ is satisfied, where A (mm) is the thickness of the thick portion of the ground electrode, and B (mm) is the distance between the base end of the inner peripheral surface of the ground electrode and the distal end surface of the ground electrode in the horizontal direction, so that the ground electrode is bent comparatively tight. In this case, at a position of the distal end portion of the ground electrode apart from the center (line) in the thickness direction of the ground electrode, larger residual stresses caused by bending may remain.

In this regard, as described above, the noble metal tip is joined to and partially embedded in the inner peripheral surface of the thin portion, so that the joined surface of the noble metal tip can be made closer to the center of the ground electrode in the thickness direction. As a result, even when the spark plug is used for a long period of time, deterioration in the peel resistance due to the residual stresses can be prevented.

In a sixth aspect, the present invention provides the spark plug according to any of the first to fifth aspect, wherein $0.1 \leqq E \leqq 0.5$ is satisfied where E (mm) is an amount of an embedded portion of the noble metal tip from the inner peripheral surface of the thin portion.

When the embedded amount E of the noble metal tip is smaller than 0.1 mm, welding may not be sufficient, and joint strength may not be sufficiently satisfied. On the other hand, when the amount E is more than 0.5 mm, the joint strength is improved but welding becomes difficult. Particularly, when welding is performed by resistance welding, embedding the noble metal tip in the ground electrode at more than 0.5 mm requires an excessive current flow, and in the base metal of the ground electrode, a melt solidification called dendrite is formed, and this may deteriorate the oxidation resistance. In this regard, in the sixth aspect, the embedded amount E satisfies $0.1 \leqq E \leqq 0.5$, so that the above problem does not occur.

In a seventh aspect, the present invention provides the spark plug according to any of the first to sixth aspects, wherein the stepped portion and the thin portion are formed by cutting or pressing the distal end portion of the straight rod-shaped ground electrode, thereafter welding the noble metal tip to the distal end portion, and thereafter bending the ground electrode.

When machining the ground electrode, for example, as in the seventh aspect, by cutting a part of the distal end portion of the straight rod-shaped ground electrode including a thick portion having a uniform thickness, or pressing the distal end portion of the ground electrode, the stepped portion and the thin portion can be formed. In addition, by welding the noble metal tip and then bending the ground electrode, the gap can be easily finely adjusted. On the other hand, in comparison with the case where the noble metal tip is welded after bending, the residual stresses may be more easily transmitted to the joined surface of the noble metal tip. However, as described above, the noble metal tip is welded to the inner peripheral surface of the thin portion formed by cutting or press forming. Therefore, the joined portion of the noble metal tip can be positioned at a portion where the residual stresses caused by bending are comparatively small, and therefore, deterioration in the peel resistance can be prevented.

In an eighth aspect, the present invention provides the spark plug according to any of the first to seventh aspects, wherein the noble metal tip has a prism shape.

As in the eighth aspect, the noble metal tip having a prism shape can suppress an increase in discharge voltage. Particularly, when a discharge is performed between the noble metal tip and the outer periphery of the leading end portion of the center electrode, a stable spark discharge is easily realized.

In a ninth aspect, the present invention provides the spark plug according to any of the first to eighth aspects, wherein a depth of the stepped portion is larger than a thickness of the noble metal tip.

According to the ninth aspect, the depth of the stepped portion is larger than the thickness of the noble metal tip, and correspondingly, the thin portion is thinned. Therefore, the residual stresses caused by bending of the thin portion can be made smaller, and as a result, the above-described operation and effect can be reliably obtained.

The discharge directions in the spark plugs of the above-described aspects are not especially limited, but may be as shown in the following a tenth aspect, an eleventh aspect, or a twelfth aspect.

In the tenth aspect, the present invention provides the spark plug according to any of the first to ninth aspects, wherein the noble metal tip protrudes from the distal end surface of the ground electrode, and wherein a protruding end surface in the protruding direction of the noble metal tip is disposed to face the leading end portion of the center electrode, to perform a spark discharge substantially along a direction perpendicular to the direction of the axis line.

As in the tenth aspect, it is considered that the technical idea of each aspect described above is embodied in the spark plug in which a spark discharge is performed in a lateral (horizontal) direction. Accordingly, the spark propagation capability can be further improved.

Particularly, the distal end surface of the ground electrode should not reach the axis line in the spark plug of the tenth aspect, the stresses caused by bending may remain at the distal end portion of the ground electrode. However, as described above, the joined portion of the noble metal tip can be positioned at a portion where the residual stresses caused by bending are comparatively small. Therefore, even if the spark plug is used for a long period of time, deterioration in the peel resistance due to the residual stresses can be prevented.

In the eleventh aspect, the present invention provides the spark plug according to any of the first to ninth aspects, wherein the noble metal tip protrudes from the distal end surface of the ground electrode, and wherein an end surface of the noble metal tip located at an end in the direction of the axis line is disposed to face the leading end portion of the center electrode to perform a spark discharge in a direction substantially along the direction of the axis line.

As in the eleventh aspect, the technical ideas of the above-described aspects may be embodied in the spark plug which performs the spark discharge in the longitudinal direction in a manner.

In the twelfth aspect, the present invention provides the spark plug according to any of the first to ninth aspects, wherein the noble metal tip protrudes from the distal end surface of the ground electrode, and protruding end surface in the protruding direction of the noble metal tip is disposed to face a part of the axis line which is positioned in a leading end side farther than the center electrode to perform a spark discharge diagonally with respect to the direction of the axis line.

As in the twelfth aspect, the technical ideas of the above-described aspects may be embodied in a spark plug which performs the spark discharge in a diagonal direction.

In a thirteenth aspect, the present invention provides the spark plug according to any of the first to twelfth aspect, wherein the inner peripheral surface of the thin portion of the ground electrode has a flat surface perpendicular to the direction of the axis line.

According to the thirteenth aspect, the surface to which the noble metal tip is joined is a flat surface, so that the joining state can be stabilized in comparison with the case where it is joined to a curved surface or slope.

The spark plugs of the above-described aspects may be produced according to, for example, the following production method of a fourteenth aspect.

In the fourteenth aspect, the present invention provides a method for producing the spark plug according to any of the first to thirteenth aspects, said method comprising: forming the stepped portion and the thin portion by cutting or pressing the leading end portion of a straight rod-shaped ground electrode; welding the noble metal tip to the inner peripheral surface of the thin portion to embedding a part of the noble metal tip in the inner peripheral surface of the thin portion; and bending the ground electrode to adjust the gap after said welding, wherein said forming the stepped portion and the thin portion, cutting or press is performed so that the stepped portion has a straight portion when viewed from the side surface of the ground electrode, and the welding step is performed so that following relationships are satisfied: $M2-N \geqq 0.3$ (mm); and $0.5$ (mm) $\leqq N \leqq 1.5$ (mm) where, when the ground electrode before being bent is viewed from the side surface, M2 (mm) is the distance between the distal end of the ground electrode and the thick portion, and N (mm) is the distance between the distal end of the ground electrode and the end portion of the noble metal tip located on the stepped portion side.

According to the fourteenth aspect, $M2-N \geqq 0.3$ (mm) is satisfied where, when the ground electrode before being bent is viewed from the side surface, M2 (mm) is the distance between the distal end of the ground electrode and the thick portion, and N (mm) is the distance between the distal end of the ground electrode and the end portion of the noble metal tip located on the stepped portion side. Therefore, the protruding height of the bulge portion formed to bulge by embedding the noble metal tip can be made small, and further, it may not be formed up to the stepped portion. As a result, the spark plug for an internal combustion engine of the first or second aspect, etc., can be more reliably obtained without great difficulty.

In addition, 0.5 (mm)≦N≦1.5 (mm) is satisfied, so that oxide scale is hardly formed, and as a result, the peel resistance can be further improved. Herein, if N is smaller than 0.5 mm, a joint area may not be sufficiently secured. On the other hand, if N is more than 1.5 mm, melting of the noble metal tip into the ground electrode hardly becomes uniform, and as a result, the joint strength (weld strength) may uneven, and the peel resistance may deteriorate.

BRIEF DESCRIPTION OF THE DRAWINGS

FIG. 4A is a view before notching and FIG. 4B is a view after notching;

FIG. 5A is a view before welding and FIG. 5B is a view after welding;

DESCRIPTION OF THE EMBODIMENTS

Figure 1:
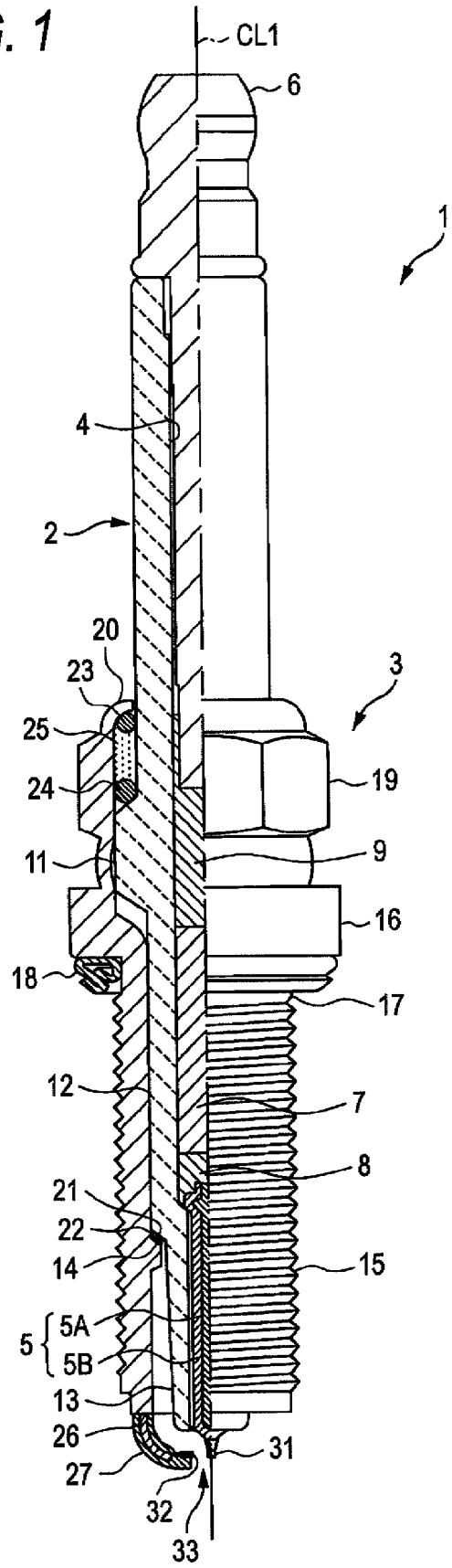
FIG. 1 is a partially cross sectional view showing a configuration of a spark plug of the present embodiment.

An embodiment of the present invention is described with reference to the drawings. However, the present invention should not be construed as being limited thereto. FIG. 1 is a partial sectional view of a spark plug 1. In the description, a direction of an axis line CL1 of the spark plug 1 (also referred to as an axial direction) corresponds to a vertical direction in FIG. 1. In addition a lower side in FIG. 1 corresponds to a leading end side of the spark plug 1, and an upper side in FIG. 1 corresponds to a base end side of the spark plug 1.

The spark plug 1 includes an insulator 2 serving as an insulating material and a cylindrical metal shell 3 holding the insulator 2.

The insulator 2 has an axial hole 4 penetrating therethrough along the axis line CL1. A center electrode 5 is inserted and fixed to the leading end portion of the axial hole 4, whereas a terminal electrode 6 is inserted and fixed to the base end portion thereof. A resistor 7 is disposed between the center electrode 5 and the terminal electrode 6 in the axial hole 4. Both ends of the resistor 7 are electrically connected to the center electrode 5 and the terminal electrode 6 via electrically-conductive glass seal layers 8 and 9, respectively.

The center electrode 5 is fixed to protrude from the leading end of the insulator 2, and the terminal electrode 6 is fixed in the state of protruding from the base end of the insulator 2. A noble metal tip (noble metal tip for a center electrode) 31 containing iridium as a main component is joined to the leading end of the center electrode 5 by welding.

On the other hand, the insulator 2 is formed by sintering alumina or the like, and has an outer shape including a flange-shaped large diameter portion 11 that protrudes radially-outwardly at a substantially center portion in the direction of the axis line CL1, an intermediate barrel portion 12 disposed on the leading end side and is smaller in diameter than the large diameter portion 11, and a leg portion 13 disposed on the leading end side and is smaller in diameter than the intermediate barrel portion 12 and that is exposed to a combustion chamber of the internal combustion engine. A leading end portion of the insulator 2, which includes the large diameter portion 11, the intermediate barrel portion 12 and the leg portion 13, is housed in the cylindrical metal shell 3. A step portion 14 is formed at the connection part between the leg portion 13 and the intermediate barrel portion 12, and firmly engages the insulator 2 with the metal shell 3.

The metal shell 3 contains metal, such as low-carbon steel, and is formed in a cylindrical shape. The metal shell 3 has an outer circumferential surface provided with a threaded portion 15 (male screw portion) used to attach the spark plug 1 to a cylinder head of the engine. A seat portion 16 is formed on the outer circumferential surface on the base end side of the threaded portion 15. A ring-shaped gasket 18 is fitted to a screw neck 17 formed at the base end of the threaded portion 15. A tool-engaging portion 19 of hexagon in cross section used to engage a tool, such as a wrench, when the metal shell 3 is attached to the cylinder head is disposed on the base end side of the metal shell 3. Additionally, a crimping portion 20 used to hold the insulator 2 at its base end portion is disposed on the base end side of the metal shell 3.

The metal shell 3 has an inner circumferential surface provided with a step portion 21 used to engage the insulator 2. The insulator 2 is inserted from the base end side toward the leading end side of the metal shell 3, and the step portion 14 thereof is firmly engaged with the step portion 21 of the metal shell 3. In this state, an opening on the base end side of the metal shell 3 is tightened radially inwardly, i.e., the crimping portion 20 is formed, and, as a result, the insulator 2 is firmly fixed. An annular plate packing 22 is interposed between the step portion 14 of the insulator 2 and the step portion 21 of the metal shell 3. Accordingly, the airtightness of the combustion chamber is maintained, so that fuel air that enters a gap between the leg portion 13 of the insulator 2 exposed to the combustion chamber and the inner circumferential surface of the metal shell 3 cannot leak outwardly.

Additionally, to be more completely sealed up by crimping, annular ring members 23 and 24 are interposed between the metal shell 3 and the insulator 2 on the base end side of the metal shell 3, and the gap between the ring members 23 and 24 is filled with talc powder 25. In other words, the metal shell 3 holds the insulator 2 by means of the plate packing 22, the ring members 23 and 24, and the talc powder 25.

A ground electrode 27 is joined to the leading end surface 26 of the metal shell 3. More specifically, the ground electrode 27 includes a base end portion welded to the leading end surface 26 of the metal shell 3, and a distal end portion bent toward the side of the axis line CL1 so that a distal end surface of the distal end portion can, almost exactly face the outer circumferential surface of the noble metal tip 31. In the present embodiment, the ground electrode 27 is provided with a noble metal tip (a noble metal tip for ground electrode) 32 disposed so as to face the noble metal tip 31. In more detail, the noble metal tip 32 is welded to the ground electrode 27 such that a part of the noble metal tip 32 is embedded therein, and another part of the noble metal tip 32 protrudes from the distal end surface 27*s* on the side of the axis line CL1 of the ground electrode 27 toward the axis line CL1 (see FIG. 2). The gap between these noble metal tips 31 and 32 serves as a spark discharge gap 33. Therefore, in the present embodiment, a spark discharge is to be performed in the direction substantially perpendicular to the direction of the axis line CL1.

Figure 2:
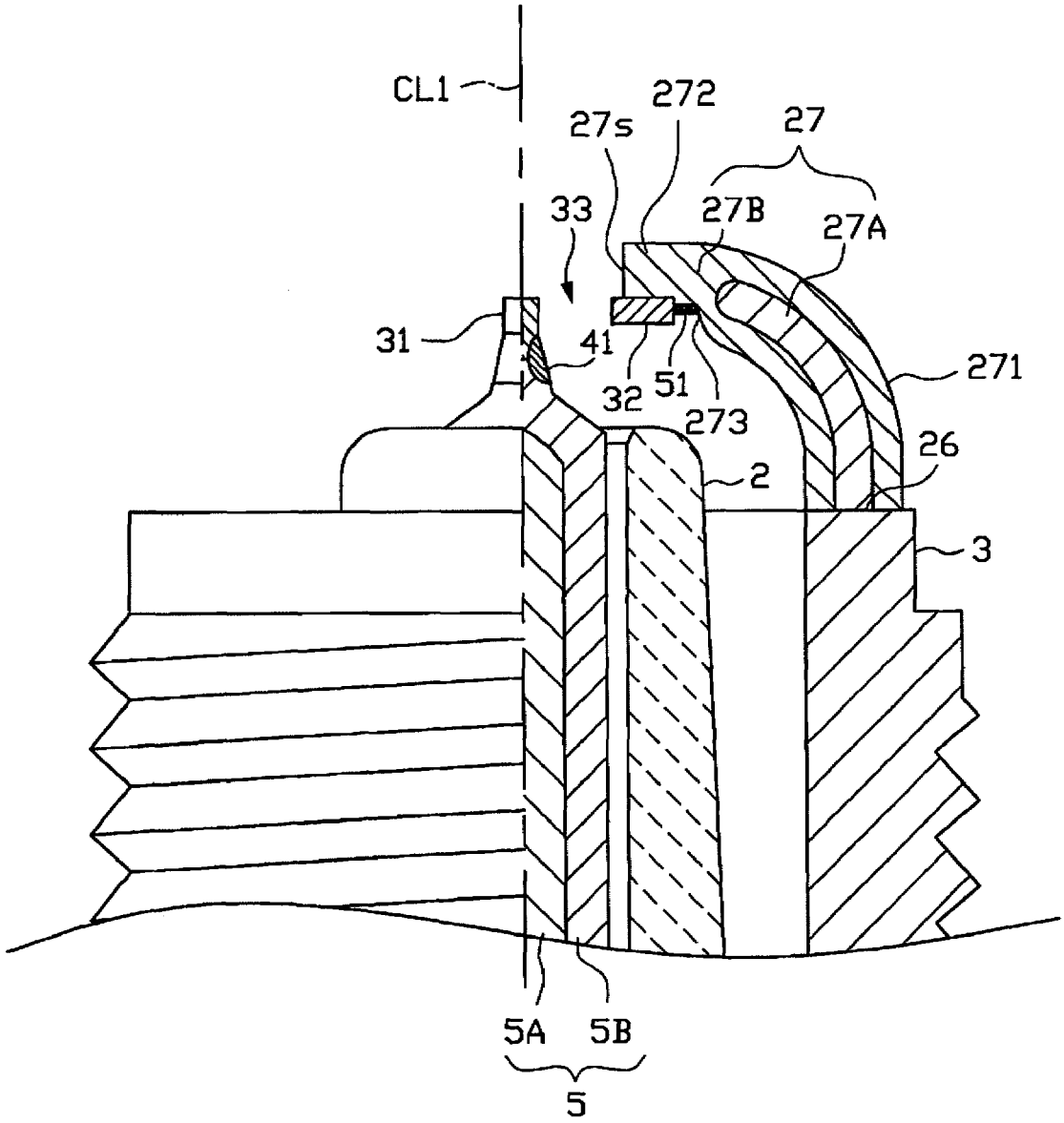
FIG. 2 is a partially enlarged cross sectional view of the spark plug.

As shown in FIG. 2, a main body of the center electrode 5 includes an inner layer 5A containing copper or a copper alloy and an outer layer 5B containing a nickel (Ni) alloy. The main body of the center electrode 5 includes a leading end portion reduced in diameter, has a rod-shaped (cylindrical) shape as a whole, and has a leading end surface formed flat. The cylindrical noble metal tip 31 is laid on this, and the outer edge of the resulting joint area is subjected to laser beam welding or electron beam welding etc. As a result, the noble metal tip 31 and the main body of the center electrode 5 are melted together, and a molten bond 41 is formed. In other words, the noble metal tip 31 is joined to the leading end of the main body of the center electrode 5 by being firmly fixed by the molten bond 41.

On the other hand, the ground electrode 27 has a two-layer structure including an inner layer 27A and an outer layer 27B. The outer layer 27B in the present embodiment contains a nickel alloy, such as INCONEL (trade name) 600 or 601, whereas the inner layer 27A contains a nickel alloy or pure copper that is metal superior in thermal conductivity to the above-mentioned nickel alloy. Since the inner layer 27A is provided, heat dissipation property can be improved. In the present embodiment, basically, the ground electrode 27 has a substantially rectangular shape in cross section.

Although the fact that the noble metal tip 31 disposed on the side of the center electrode 5 containing iridium as a main component has been mentioned above, the noble metal tip 32 disposed on the side of the ground electrode 27 contains a noble metal alloy containing rhodium in an amount of 20 mass % and a main component such as platinum. However, these material compositions are mentioned as an example, but not limited thereto. For example, the noble metal tips 31 and 32 are produced as follows. First, an ingot containing iridium or platinum as a main component is prepared, respective alloying elements are then mixed and melted to form the predetermined composition mentioned above, an ingot is then formed for the melted alloy again, and is subjected to hot forging and hot rolling (groove rolling). Thereafter, this is subjected to wire drawing, and, as a result, a rod-shaped material is obtained. Thereafter, this is cut to have a predetermined length, and, as a result, the cylindrical noble metal tip 31 and the prism-shaped noble metal tip 32 can be obtained.

As described above, the noble metal tip 32 joined to the ground electrode 27 protrudes toward the axis line CL1 from the distal end surface 27*s* of the ground electrode 27 on the axis line CL1 side. Particularly, in the present embodiment, as shown in FIG. 2 and FIG. 3, the ground electrode 27 includes a thick portion 271 positioned on a base end side of the ground electrode 27, a thin portion 272 positioned on a distal end side of the ground electrode 27, and a stepped portion 273 provided on an inner peripheral surface side (lower surface side in FIGS. 2 and 3) between the thick portion 271 and the thin portion 272. In the present embodiment, the inner peripheral surface of the thin portion 272 has a flat surface 27*f* extending in a direction perpendicular to the axis line CL1. In other words, the inner peripheral side of the distal end portion of the ground electrode 27 is notched into a hook shape so as to provide the stepped portion 273 and the flat surface 27*f*. The noble metal tip 32 is welded to and partially embedded in the flat surface 27*f*.

Figure 3A:
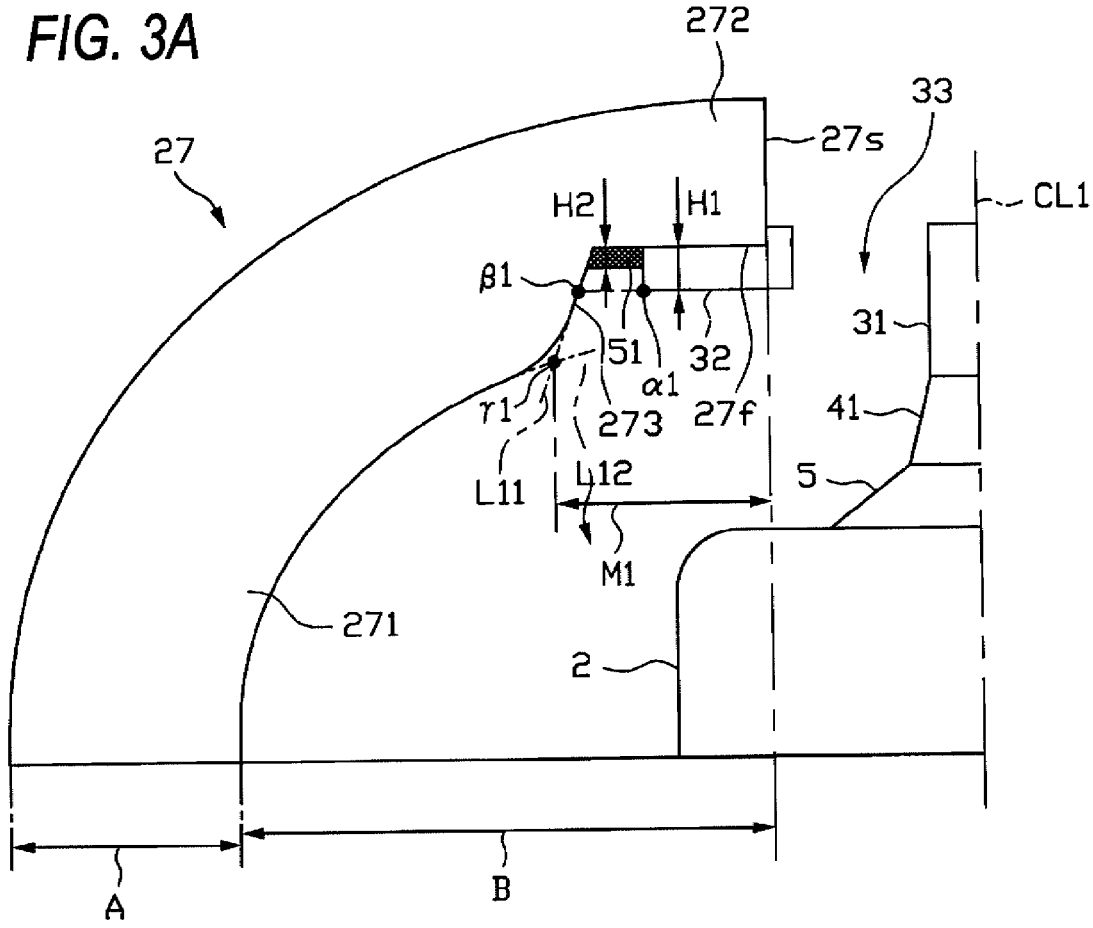
FIG. 3A is a schematic side view showing a major portion of the ground electrode, etc., in an enlarged manner.
Figure 3B:
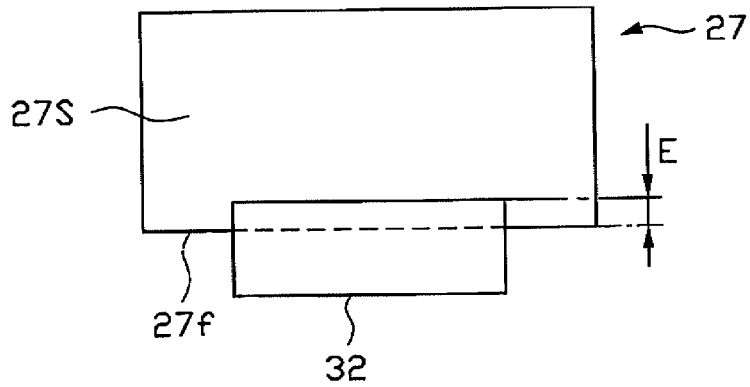
FIG. 3B is a front view (back side is not shown) showing the ground electrode viewed from the distal end surface side.

As shown in FIG. 3A, when viewed from a side surface of the ground electrode 27, by embedding the noble metal tip 27, a bulge portion (portion shaded by a mesh pattern in the figure) containing the same metal component as that of the ground electrode 27 (external layer 27B) is formed (in the present embodiment, referred to as "bulge portion 51). In the present embodiment, the relationship of [a protruding height H1 of the noble metal tip 32 from the inner peripheral surface of the thin portion 272]≧[a protruding height H2 of the bulge portion 51 from the inner peripheral surface of the thin portion 272] is satisfied.

The distance (distance of line segment α1-β1 in FIG. 3A) between an end portion of the noble metal tip 32 on the stepped portion side (i.e., point α1 in FIG. 3A) and the stepped portion 273 in the direction perpendicular to the direction of the axis line CL1 (i.e., a horizontal direction) is 0.1 mm or more.

Further, as shown in FIG. 3, the stepped portion 273 has a straight portion, and M1≦0.75 B is satisfied where a boundary point γ1 is an intersection of an extension line L11 of the straight portion and an extension line L12 of the inner peripheral surface of the thick portion 271, M1 (mm) is the distance between the distal end surface 27*s* of the ground electrode 27 and the boundary point γ1 in the direction perpendicular to the direction of the axis line CL1, and B (mm) is the distance between the distal end surface 27*s* of the ground electrode 27 and the base end of the inner peripheral surface of the ground electrode 27 in the direction perpendicular to the direction of the axis line CL1.

In addition, B/A≦2.5 is satisfied where A (mm) is the thickness of the thick portion 271 of the ground electrode 27. Therefore, the ground electrode 27 is bent in a comparatively tight manner.

Further, 0.1≦E≦0.5 is satisfied where E (mm) is the embedded amount of the noble metal tip 32 from the inner peripheral surface of the thin portion 272.

Next, a description will be given of a method of producing the spark plug 1 while centering on a process of producing the ground electrode 27 and the like. First, the metal shell 3 is pre-processed. In more detail, a cylindrical metallic material (for example, a stainless material or an iron-based material such as S15C or S25C) is subjected to cold forging so as to form a through-hole, and forms its outline. Thereafter, the resulting material is subjected to a cutting process so as to adjust the outline, thus obtaining a metal shell intermediate body.

On the other hand, a semi-finished material for the ground electrode 27 having a rectangular shape in cross section is produced. That is, the semi-finished material for the ground electrode 27 is a rod-shaped material that has not yet been bent. For example, the ground electrode 27 that has not yet been bent can be obtained as follows.

In detail, a core containing a metallic material used for the inner layer 27A and a bottomed cylinder containing a metallic material used for the outer layer 27B are prepared (both not shown). Thereafter, a cup material is formed by fitting the core to a concave part of the bottomed cylinder. Thereafter, the cup material having the two-layer structure is subjected to a cold thinning process. For example, a wire drawing process using a die or the like or an extrusion molding process using a female die or the like can be mentioned as the cold thinning process. Thereafter, the resulting material is subjected to, for example, a swaging process, and, as a result, a rod-shaped product reduced in diameter is formed.

Thereafter, the ground electrode 27 (rod-shaped product) that has not yet been bent and has not yet been attached to a tip is joined to the leading end surface of the metal shell intermediate body by resistance-welding. Since a so-called "sag" is generated when the resistance welding is performed, an operation to remove the "sag" is performed. In this example, after performing the swaging process, the cutting process, etc., the ground electrode 27 that has not yet been bent is joined according to resistance-welding. However, after performing the thinning process, the rod-shaped product may be joined to the metal shell intermediate body. Thereafter, the swaging process may be performed, and then the cutting process may be performed. If so, when the swaging process is performed, the rod-shaped product joined to the leading end surface of the metal shell intermediate body can be introduced from the leading end side into a processing part (swaging die) of a swager in the state of holding the metal shell intermediate body. Therefore, it becomes unnecessary to purposely set the rod-shaped product to be long in order to secure a part used to hold it when the swaging process is performed.

Thereafter, the threaded portion 15 is formed at a predetermined portion of the metal shell intermediate body by being screwed. As a result, the metal shell 3 to which the ground electrode 27 before being bent is welded is obtained. The metal shell 3 and the other elements are subjected to galvanizing or nickeling. To improve corrosion resistance, the surface of the metal shell 3 may be further subjected to chromating.

Figure 4A:
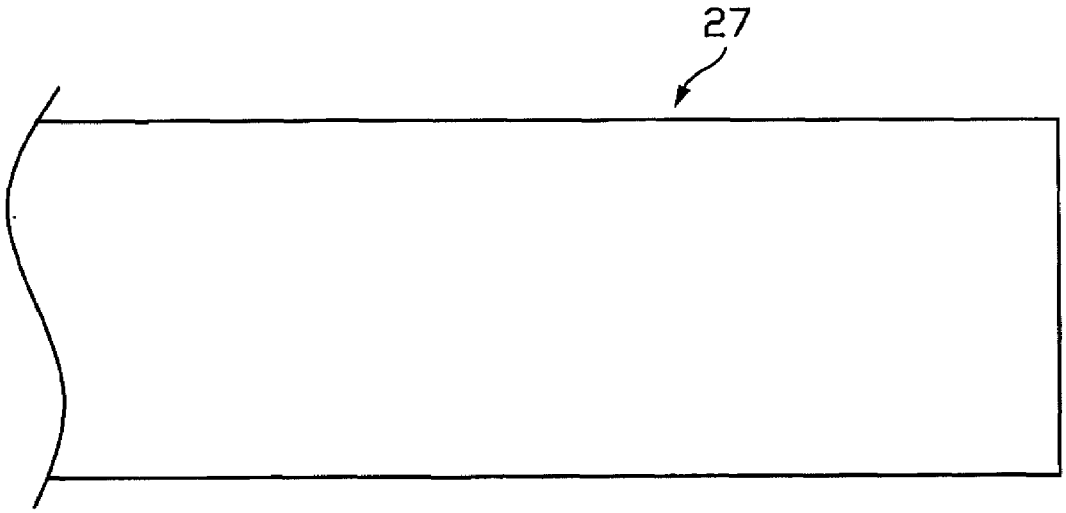
FIG. 4A and FIG. 4B are side views schematically showing production steps of the ground electrode.
Figure 4B:
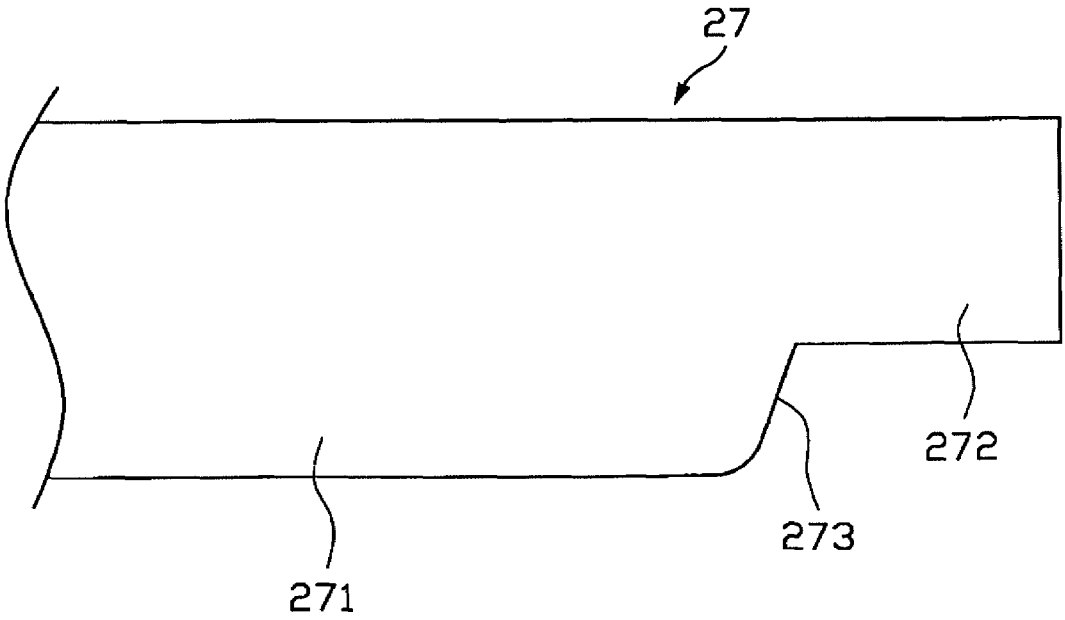

As shown in FIG. 4A and FIG. 4B, the distal end portion of the ground electrode 27 is notched in a hook shape by cutting or pressing to form a flat surface 27*f* (the thin portion 272 and the stepped portion 273). The notching may be performed after or before roll-threading a threaded portion 15. When the notching is performed before roll-threading the threaded portion 15, it may be before or after welding to a metal shell intermediate body.

Figure 5A:
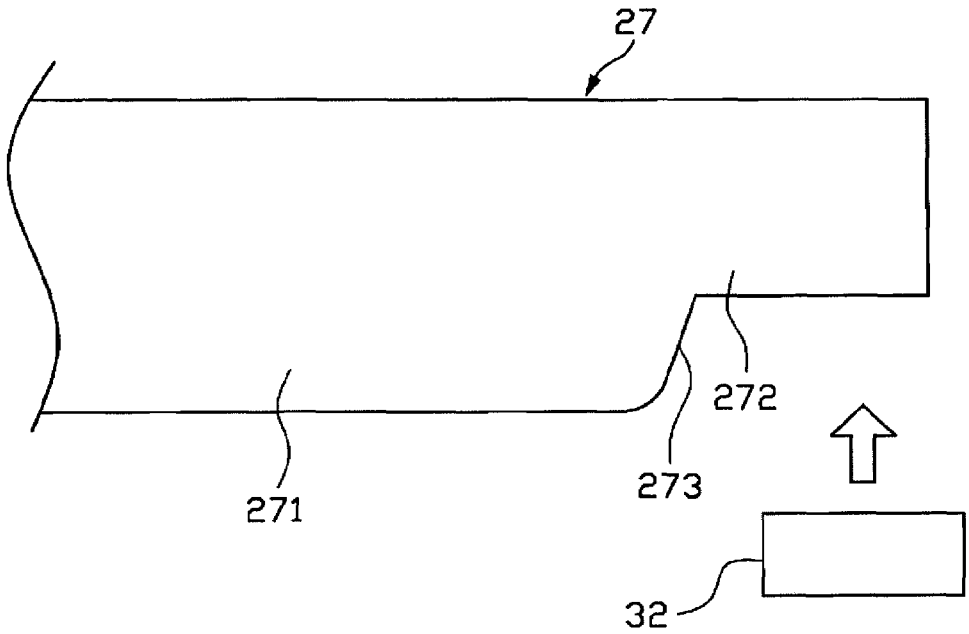
FIG. 5A and FIG. 5B are side views schematically showing production steps of the ground electrode.

On the other hand, as described above, a prism-shaped noble metal tip 32 is prepared, and this noble metal tip 32 is joined by resistance welding to the ground electrode 27 as shown in FIG. 5A. At this time, resistance welding is performed while the noble metal tip 32 is pressed against the flat surface 27*f* of the ground electrode 27 so that the embedded amount E (mm) of the noble metal tip 32 in the flat surface 27*f* satisfies $0.1 \leqq E \leqq 0.5$.

Figure 5B:
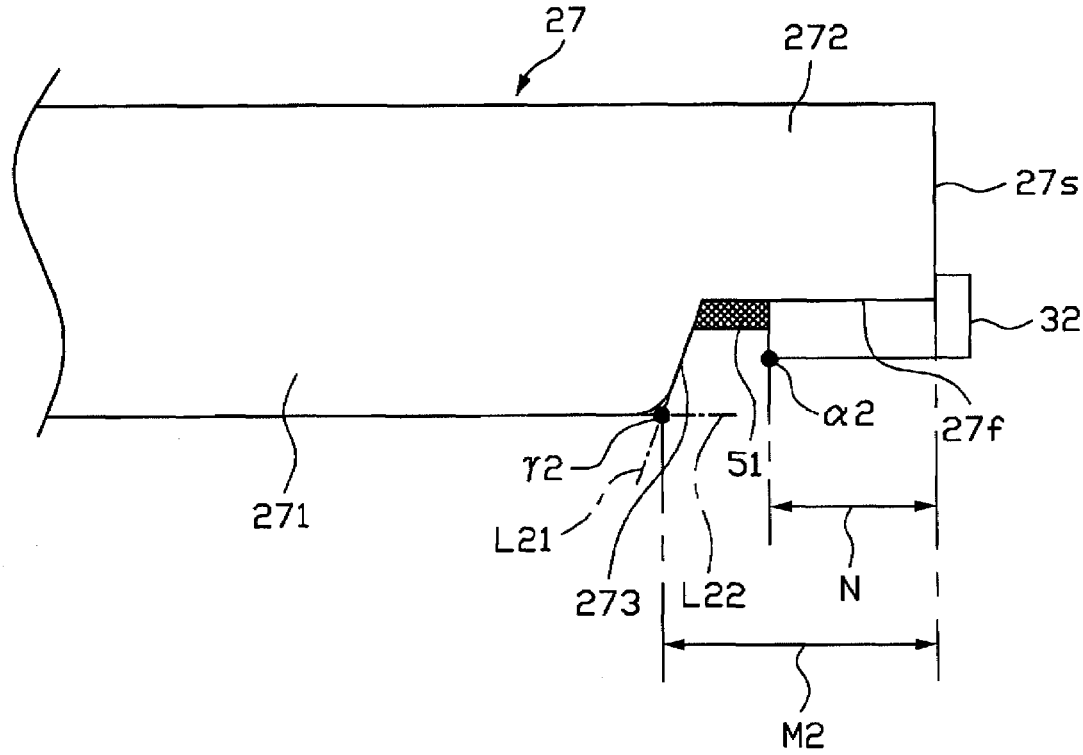

In this case, as shown in FIG. 5B, the resistance welding is performed such that a relationship $M2-N \geqq 0.3$ (mm) and a relationship $0.5\ (mm) \leqq N \leqq 1.5\ (mm)$ are satisfied where, when the ground electrode 27 (before being bent) is viewed from the side surface, M2 (mm) is the distance between the distal end (distal end surface 27*s*) of the ground electrode 27 and thick portion 271, and N (mm) is the distance between the distal end (distal end surface 27*s*) of the ground electrode 27 and an end portion of the noble metal tip 32 on the stepped portion 273 side. As a method of calculating the distance between the distal end (distal end surface 27*s*) of the ground electrode 27 and the thick portion 271, for example, as shown in the FIG. 5, a method is available in which the distance between the intersection $\gamma 2$ of the extension line L21 of the straight portion of the stepped portion 273 and the extension line L22 of the inner peripheral surface of the thick portion 271 and the distal end (distal end surface 27*s*) of the ground electrode 27 is measured. As a method of calculating the distance between the distal end (distal end surface 27*s*) of the ground electrode 27 and the end portion of the noble metal tip 32 on the stepped portion 273 side, a method is available in which the distance between the end portion on the base end side of the noble metal tip 32 (i.e., a point corresponding to the point $\alpha 1$, referred to as a point $\alpha 2$ in FIG. 5B) and the distal end of the ground electrode 27 (i.e., the distal end surface 27*s*) is measured.

To make the welding more reliable, plating removal at the welding portion is performed or masking is applied to the portion to be welded in the plating step before the welding. It is also possible that the noble metal tip 32 is welded after the fitting described later (before bending).

On the other hand, the insulator 2 is molded independently of the metal shell 3. For example, a basis granulation material for molding is prepared by use of raw powder containing alumina as a main component and a binder, and rubber press molding is performed by using this, and, as a result, a cylindrical mold is obtained. The resulting mold is ground and shaped. Thereafter, the shaped mold is put into a baking furnace and is baked, and, as a result, the insulator 2 is obtained.

Additionally, the center electrode 5 is produced independently of the metal shell 3 and the insulator 2. In detail, a Ni-based alloy is forged, and a copper core is disposed at the middle of the Ni-based alloy in order to improve heat radiation, thus obtaining the main body. Thereafter, the noble metal tip 31 as mentioned above is joined to the leading end portion of the center electrode by laser beam welding or the like.

The obtained center electrode 5 to which the noble metal tip 31 is joined and the terminal electrode 6 are airtightly fixed to the axial hole 4 of the insulator 2 by means of a glass seal (not shown). Generally, a seal formed by mixing and preparing borosilicate glass and metal powder together is used as the glass seal. Thereafter, the center electrode 5 is first brought into the state of being inserted in the axial hole 4 of the insulator 2, the prepared sealant is then put into the axial hole 4 of the insulator 2, the terminal electrode 6 is then pressed from the rear, and these are baked in the baking furnace. At this time, a glaze layer may be baked at the same time on the surface of the barrel portion on the base end side of the insulator 2, or a glaze layer may be beforehand formed.

Thereafter, the insulator 2 having the center electrode 5 and the terminal electrode 6 structured as above, respectively, and the metal shell 3 having the straight rod-shaped ground electrode 27 structured as above are assembled together. In more detail, the base end portion of the metal shell 3 formed to be comparatively thin is subjected to cold crimping or hot crimping, and hence is held such that a part of the insulator 2 is surrounded by the metal shell 3 from the circumferential direction.

Finally, the straight rod-shaped ground electrode 27 is bent, and a process to adjust the spark discharge gap 33 between the center electrode 5 (the noble metal tip 31) and the ground electrode 27 (the noble metal tip 32) is performed.

The spark plug 1 structured as above is produced by following these series of steps.

As described in detail above, according to the present embodiment, the prism-shaped noble metal tip 32 is welded so as to protrude toward the axis line CL1 from the distal end surface 27*s* of the ground electrode 27, and a spark discharge is performed laterally. Therefore, ignitability or spark propagation capability can be improved as well as spark wear resistance.

On the other hand, the ground electrode 27 of the present embodiment is comparatively tightly bent, and at the distal end portion of the ground electrode 27, in particular, at a position apart from the center (line) in the thickness direction of the ground electrode 27, comparatively large residual stresses (for example, compressive stresses) caused by bending may remain. In this regard, in the present embodiment, the inner side of the distal end portion of the ground electrode 27 is notched so as to include a flat surface 27*f*, and the noble metal tip 32 is welded to and partially embedded in the flat surface 27*f*. The joined surface of the noble metal tip 32 can be made closer to the center of the ground electrode 27 in the thickness direction. In other words, the joined portion of the noble metal tip 32 can be positioned at a portion where the residual stresses caused by bending are comparatively small. Therefore, even when the spark plug is used for a long period of time, deterioration in the peel resistance due to the residual stresses can be prevented.

In the present embodiment, embedding the noble metal tip 32 a portion containing the same metal component as of the ground electrode 27 is formed to protrude from the flat surface 27*f*. When this portion is defined as the bulge portion 51, the relationship of [the protruding height H1 of the noble metal tip 32 from the inner peripheral surface of the thin portion 272]≧[the protruding height H2 of the bulge portion 51 from the inner peripheral surface of the thin portion 272] is satisfied. In other words, when viewed from the side surface of the ground electrode 27, if a horizontal line is drawn toward the stepped portion 273 from the end portion on the base end side of the noble metal tip 32, the bulge portion 51 does not protrude over the horizontal line. Therefore, when the ground electrode 27 is bent, a reactive force caused by this bending is hardly applied to the noble metal tip 32 from the bulge portion 51. Therefore, deterioration in the peel resistance of the noble metal tip 32 due to the presence of the bulge portion 51 can be prevented.

Here, to confirm the effects mentioned above, various samples were formed, and various valuations were made. The experimental results are explained below.

Figure 6A:
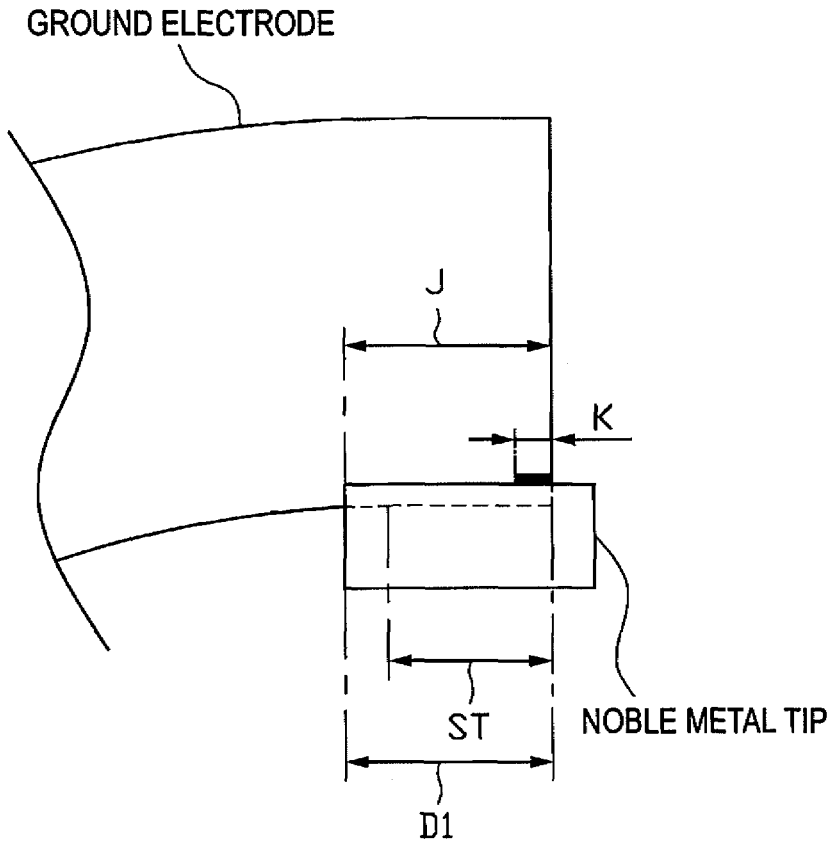
FIG. 6A and FIG. 6B are cross sectional end views for describing the concept of samples to be used in the valuation test (hatching is not shown for convenience)
Figure 6B:
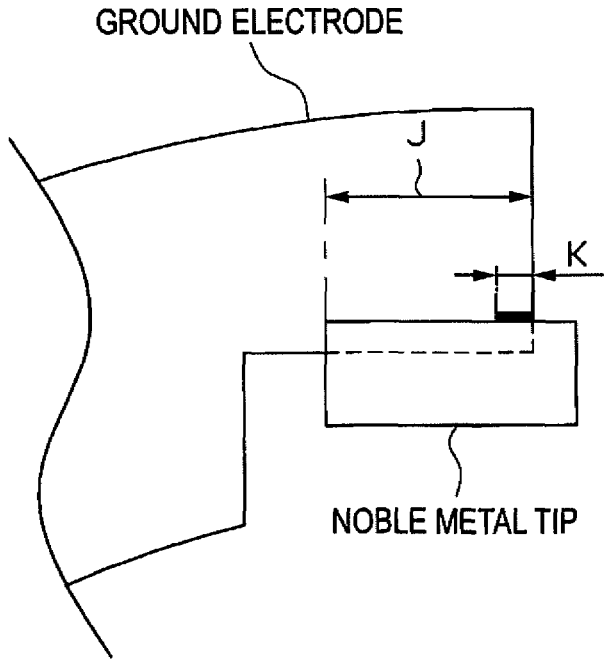

Before explaining the evaluation of the effects of the present embodiment, various experiments were performed for the case where a noble metal tip is welded to the inner peripheral surface of the ground electrode so as to protrude in the direction of the axis line, the inner peripheral surface was not notched (that is, the ground electrode were formed only by the thick portion). First, as shown in FIG. 6A, a distance D1 is defined as, when viewed from a side surface of the ground electrode, a distance between ends of a contact surface of the inner peripheral surface which contacts the noble metal tip when the noble metal tip is joined (substantially corresponding to "N" in the above embodiment), and a straight length ST is defined as a length of the distal end portion of the ground electrode at which the surface is flat in cross section [i.e., a length of the portion where the distal end inner side surface is formed into a flat surface (straight in section)]. Samples were prepared in which the distances D1 were set to 0.5 mm, 1.0 mm, and 1.5 mm, and the various straight lengths ST were set for each D1, and then a tendency to develop oxide scale was evaluated for each sample. In detail, ground electrode samples (not notched) in which the distance D1 and the distal end straight length ST were variously changed were manufactured, and a desk burner test was conducted. The desk burner test includes repeated cycles, and each cycle includes: heating the sample for 2 minutes by a burner such that the distal end temperature reaches 1100° C.; and then slowly cooling the supple for 1 minute. Thereafter, by observing a cross section of the sample, the ratio of a length K of a formed oxide scale (see the schematic view of FIG. 6A) to the length J of a boundary surface region between the ground electrode and the noble metal tip (see also FIG. 6A) was measured, and the number of cycles when the oxide scale ratio exceeded 50% was evaluated. Here, a peeling limit is defined as the number of cycles when the oxide scale ratio exceeded 50% is less than 1000. However, when the oxide scale ratio does not exceed 50% even after repeating the cooling and heating cycle 1500 times, the peel resistance was evaluated as sufficient and the test was ended at 1500 cycles. The results of this test are shown in FIG. 7.

Figure 7:
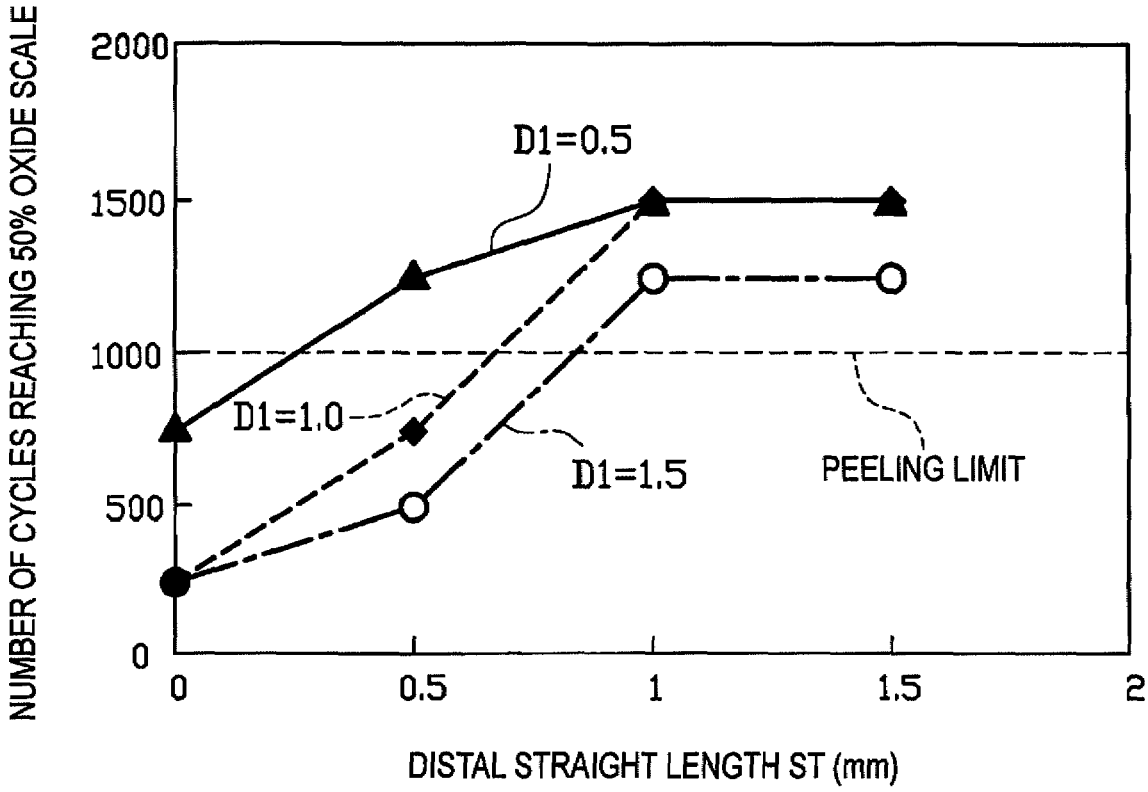
FIG. 7 is a graph showing the relationship of the number of cycles reaching 50% oxide scale to the distal end straight length ST in ground electrode samples in which the distance D1 to the contact surface and the distal end straight length ST are variously changed.

As seen in FIG. 7, it was found that, in the range of 0.5 to 1.5 mm of the distance D1, when the straight length ST of the distal end portion of the ground electrode was 1.0 mm or more, the number of cycles reaching 50% oxide scale exceeded 1000. In other words, when the straight length ST of the distal end portion of the ground electrode is 1.0 mm or more, there is no need to concern about the peel resistance of the noble metal tip. On the other hand, it was found that when the straight length ST of the distal end portion of the ground electrode was only less than 1.0 mm, it adversely influenced the peel resistance of the noble metal tip. In other words, when bending stresses remain on the ground electrode distal end portion, the peel resistance of the noble metal tip is easily deteriorated.

From the results of the test, when the straight length ST of the distal end portion (inner side) of the ground electrode is 1.0 mm or more, there is no need to concern about the peel resistance of the noble metal tip. Based on this, samples variously changed so that the straight length ST of the distal end portion (inner side) of the ground electrode became 1.0 mm, the thickness A of the thick portion of the ground electrode was changed to 1.0 mm, 1.3 mm, and 1.6 mm, and the value of B/A became "1.5," "2.0," "2.5," and "3.0" were manufactured and subjected to a heating and vibration durability test. In detail, while the bent portion of the ground electrode in each sample was heated to 900° C., vibration of a frequency of 200 Hz was continuously applied thereto, and a time required until the bent portion was broken (endurance time) was measured. When breakage did not occur for 10 hours or more, it was evaluated as having sufficient breaking strength. The results in this case are shown in FIG. 8.

Figure 8:
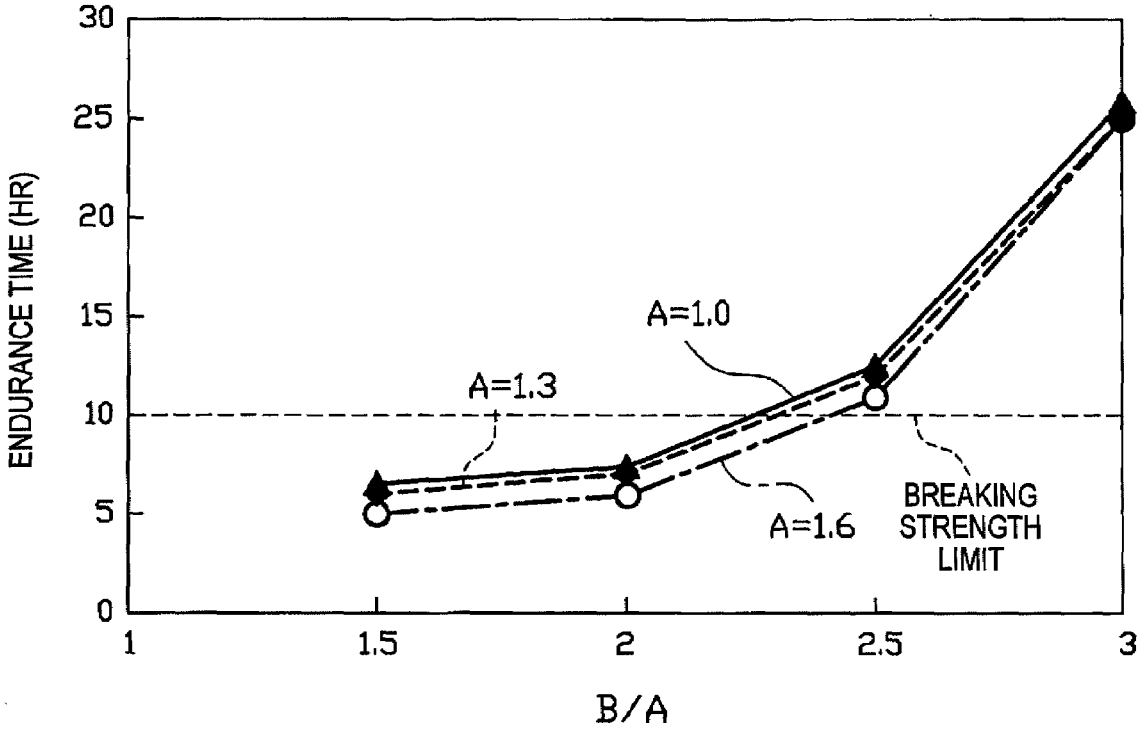
FIG. 8 is a graph showing heating and vibration test results, and showing the relationship of the endurance time to B/A.

As shown in FIG. 8, when the value of B/A is 2.5 or more, the breaking strength is sufficient. On the other hand, when the value of B/A is less than 2.5, the bent portion is easily broken, and sufficient breaking strength cannot be obtained. In other words, if the ground electrode is forcibly bent in order to secure a straight length of 1.0 mm or more on the distal end portion (inner side) of the ground electrode, the breaking strength of the bent portion may deteriorate.

On the other hand, in the present embodiment, the notching is applied to the ground electrode which has B/A of 2.5 or less to form the thin portion 272 and the stepped portion 273. In other words, when the value of B/A is 2.5 or less, forcible bending with a high curvature is inevitably applied in order to secure the predetermined straight length, which deteriorates the breaking strength. On the other hand, in the present embodiment, by forming the flat surface 27*f* by notching, even when the value of B/A is 2.5 or less, deterioration in the breaking strength due to forcible bending with a high curvature is not caused, and a sufficient straight length is secured and the peel resistance is prevented from being deteriorated.

Next, samples in which the distance between the end portion on the base end side of the noble metal tip 32 and the stepped portion 273 in the direction perpendicular to the direction of the axis line CL1 (i.e., horizontal direction), that is, the distance of the line segment α1-β1 of FIG. 3A, was changed, and the protruding height H2 of the bulge portion 51 with respect to the protruding height H1 of the noble metal tip 32 was variously changed were prepared. Then, the desk burner valuation test (the same as described above) was carried out 1000 cycles, and thereafter, by observing the cross section of the sample, the ratio of the length K of a formed oxide scale (see the schematic view of FIG. 6A) to the length J of the boundary surface region between the ground electrode and the noble metal tip (see also FIG. 6A) was measured, and the oxide scale ratio was evaluated. The results of the valuation are shown in Table 1. After this test, various tests are carried out upon providing a flat surface by notching the distal end portion of the ground electrode. In other words, the oxide scale ratio means a ratio of the length K of a formed oxide scale to the length J of a boundary surface region between the ground electrode and the noble metal tip as shown in the schematic view of FIG. 6A in the ground electrode having the flat surface. In Table 1, a rating of "○" (circle) is given when the oxide scale ratio is less than 50%, a rating of "Δ" (triangle) is given when the oxide scale ratio is not less than 50% but less than 80%, and a rating of "□" (squire) is given when the oxide scale ratio is 80% or more.

TABLE 1

| | Horizontal distance (mm) between end portion of noble metal tip on base end side and stepped portion | | | | |
|---|---|---|---|---|---|
| | 0.05 | 0.1 | 0.15 | 0.2 | 0.25 |
| H1 ≧ H2 | Δ | ○ | ○ | ○ | ○ |
| H1 < H2 (Bulge portion protruding) | □ | □ | □ | Δ | Δ |

○: less than 50% oxide scale
Δ: 50% or more oxide scale
□: 80% or more oxide scale As shown in Table 1, it was found that when the relationship of [a protruding height H1 of the noble metal tip 32 from the inner peripheral surface of the thin portion 272]≧[a protruding height H2 of the bulge portion 51 from the inner peripheral surface of the thin portion 272] was satisfied (upper row of the table), the oxide scale ratio could be made remarkably lower than in the case where this relationship was not satisfied (lower row of the table). The reason for this is considered that a reactive force caused by bending is hardly applied to the noble metal tip from the bulge portion. In addition, it was found that when the relationship of H1≧H2 is satisfied, in particular, when the horizontal distance between the end portion of the noble metal tip on the stepped portion side and the stepped portion (distance of the line segment α1-β1 of FIG. 3A) was 0.1 (mm) or more, the oxide scale ratio could be significantly lowered.

Figure 9:
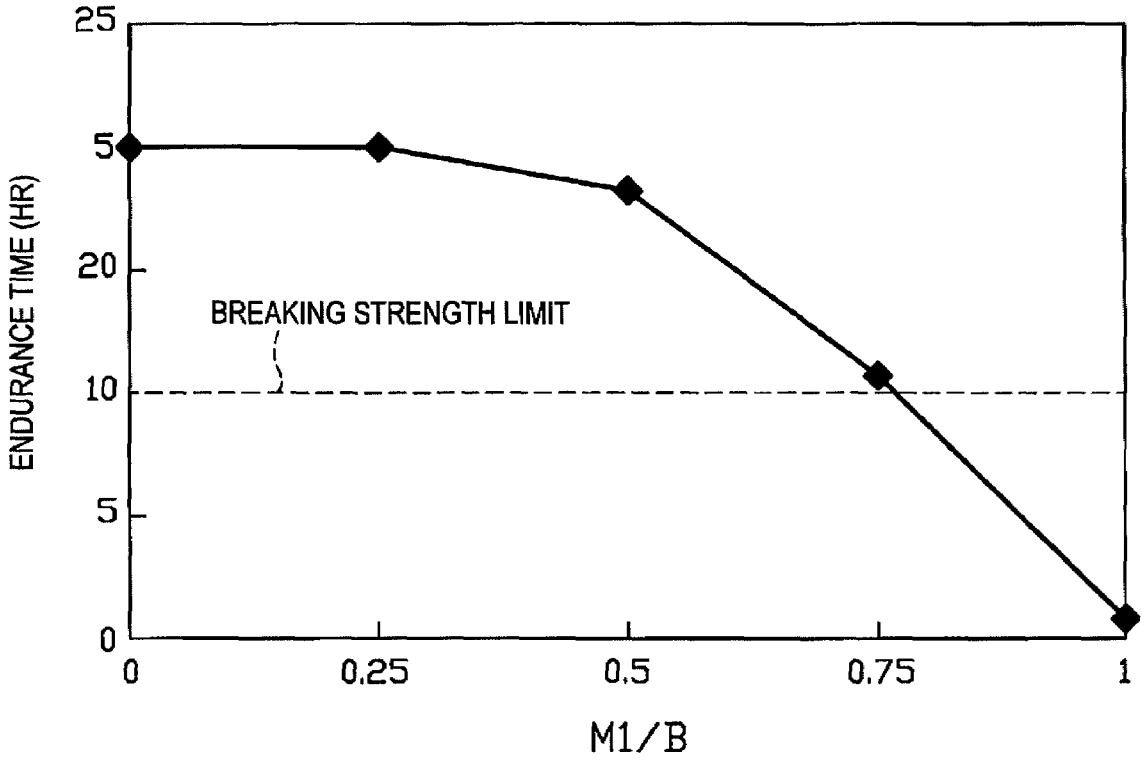
FIG. 9 is a graph showing heating and vibration test results, and showing the relationship of the endurance time to M1/B.

Next, samples with variously changed M1/B were prepared, where M1 (mm) was the distance between the distal end surface 27*s* of the ground electrode 27 and the boundary point γ1, and B (mm) was the distance between the distal end surface of the ground electrode and the base end of the inner peripheral surface of the ground electrode in the direction perpendicular to the direction of the axis line. Then, the heating and vibration durability test was carried out. In detail, while the bent portion of the ground electrode in each sample was heated to 900° C., vibration of a frequency of 200 Hz was continuously applied thereto, and a time required until the bent portion was broken (endurance time) was measured. When breakage did not occur for 10 hours or more, it was evaluated as having sufficient breaking strength. The results of this test are shown in FIG. 9.

As shown in this figure, when the value of M1/B exceeded 0.75, the breaking strength was extremely low. Therefore, due to the value of M1/B of 0.75 or less, that is, satisfying M1≦0.75 B, the thin portion is not so long in length, and excessive bending stresses on the bent portion of the ground electrode can be avoided. As a result, the breaking strength at the bent portion of the ground electrode can be prevented from being deteriorated.

Next, the numbers of cycles reaching 50% oxide scale of samples were evaluated. The samples were prepared in which the embedded amount E (mm) of the noble metal tip 32 was "0.05," "0.1," "0.2," "0.3," and "0.5," and N (mm) corresponding to the distance to the ends of the contact surface of the inner peripheral surface which contacts the noble metal tip 32 when the noble metal tip 32 was joined [that is, the distance between the distal end of the ground electrode and the end portion of the noble metal tip on the stepped portion side when the ground electrode before being bent was viewed from a side surface] was variously changed between 0.3 mm and 1.7 mm. The results are shown in FIG. 10.

Figure 10:
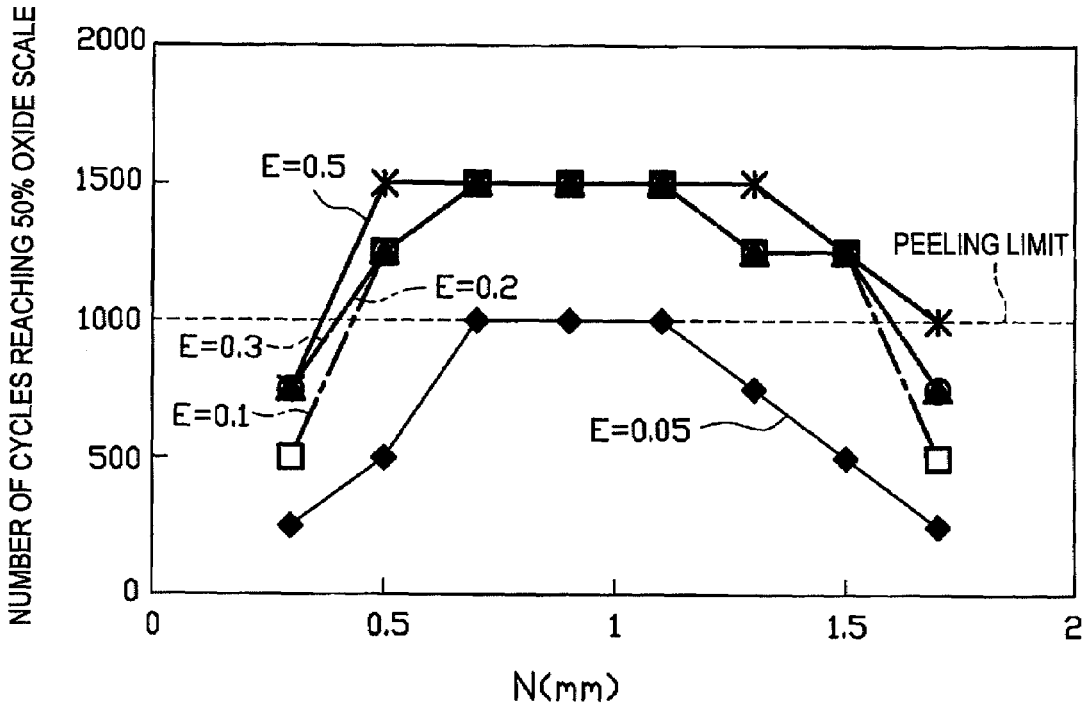
FIG. 10 is a graph showing the relationship of the number of cycles reaching 50% oxide scale to N corresponding to the distance to the contact surface with which the noble metal tip comes into contact when it is joined to the ground electrode in samples in which the embedded amount E of the noble metal tip is variously changed.

As shown in FIG. 10, when the distance N satisfied 0.5≦N≦1.5, the peel resistance became excellent. On the other hand, when N is smaller than 0.5 mm, the peel resistance is not sufficient. The reason for this is considered that a sufficient joint area cannot be secured. Also when N is more than 1.5 mm, the peel resistance is not sufficient. The reason for this is considered that if N exceeds 1.5 mm, melting of the noble metal tip into the ground electrode hardly becomes uniform, and as a result, the welding strength becomes uneven.

It was found that when the embedded amount E (mm) of the noble metal tip satisfied 0.1≦E≦0.5, the peel resistance became excellent. On the other hand, when E is smaller than 0.1 mm, the peel resistance is not sufficient. The reason for this is considered that the welding is not sufficient and satisfactory joint strength cannot be secured. Further, when E is more than 0.5 mm, the joint strength is improved, however, welding becomes difficult. Actuality, an attempt was made to manufacture a sample of E=0.6 mm, which proved difficult to manufacture. Even if it can be manufactured, when the noble metal tip is embedded at more than 0.5 mm, an excessive current is required to flow, and a melt solidification called dendrite is formed in the base metal of the ground electrode. Therefore, the oxidation resistance may be deteriorated due to the presence of the melt solidification.

Next, various samples were prepared, such that the embedded amount E (mm) of the noble metal tip 32 was changed to "0.1," "0.3," and "0.5," and the value of M2−N was variously changed, where, when the ground electrode before being bent was viewed from a side surface, M2 (mm) was the distance between the ground electrode distal end and the thick portion, and N (mm) was the distance between the ground electrode distal end and the end portion on the stepped portion side of the noble metal tip. Then, the relationship between [a protruding height H1 of the noble metal tip 32 from the inner peripheral surface of the thin portion 272] and [a protruding height H2 of the bulge portion 51 from the inner peripheral surface of the thin portion 272] after bending was evaluated. The results are shown in Table 2. In Table 2, when H1≧H2, it is determined that the bulge portion does not protrude, and a rating of "○" (circle) is given, and when H1<H2, it is determined that the bulge portion protrudes from the line segment α1-β1 and a rating of "x" (cross mark) is given.

TABLE 2

| | M2-N (mm) | | | | |
|---|---|---|---|---|---|
| | 0.1 | 0.15 | 0.2 | 0.25 | 0.3 |
| E = 0.1 (mm) | x | ○ | ○ | ○ | ○ |
| E = 0.3 (mm) | x | x | ○ | ○ | ○ |
| E = 0.5 (mm) | x | x | x | x | ○ |

○: H1 ≧ H2 (not protruding)
x: H1 < H2 (protruding)

As shown in Table 2, in the range between "0.1" and "0.5" of the embedded amount E (mm) of the noble metal tip 32, when the value of M2−N is 0.3 (mm) or more, the relationship becomes H1≧H2. In other words, a spark plug in which the bulge portion does not protrude can be obtained. From this fact, to join the noble metal tip 32, it is preferable that welding is performed so that the value of M2−N is 0.3 (mm) or more.

The present invention is not limited to the above described embodiment, and the following modified examples may be applicable thereto.

(a) In the above embodiment, the noble metal tip 32 is embodied in the case where it is joined to the ground electrode 27 by means of resistance welding, however, it is not limited to the resistance welding. Therefore, the noble metal tip may be joined by laser welding or electron beam welding.

(b) In the above embodiment, a spark plug provided with one ground electrode 27 is illustrated, however, the present invention can be embodied in a spark plug having two or more ground electrodes.

(c) In the above-described embodiment, a ground electrode 27 which has a substantially rectangular sectional shape is used, however, it is also allowed that its back surface side is curved or it has a trapezoidal sectional shape.

(d) In the above embodiment, the case where the noble metal tip 31 is joined by welding to the leading end of the main body of the center electrode 5 is embodied, however, this noble metal tip 31 for the center electrode may be omitted. In this case, the main body forms the center electrode 5.

(e) In the above embodiment, for convenience of description, the ground electrode 27 is described as having a simple two-layer structure. However, the ground electrode 27*b* may have a three-layer structure or a multi-layer structure including four or more layers. It is preferable that a layer on the inner side of the external layer 27B contains a metal having greater excellent thermal conductivity than the external layer 27B. For example, on the inner side of the external layer 27B, an intermediate layer made of a copper alloy or pure copper may be provided, and an innermost layer made of pure nickel may be provided on the inner side of the intermediate layer. A ground electrode 27 having only a single nickel layer may also be used instead of the multi-layer structure.

(f) In the above embodiment, a surface of the bulge portion 51 on the protruding side shown in FIG. 3, etc., is a flat surface for convenience of description, however, it is not necessarily a flat surface. Further, all regions of the bulge portion 51 is positioned on the leading end side in the direction of the axis line farther than the line segment α1-β1 of FIG. 3A, however, it is only required that the bulge portion does not protrude to the base end side from the line segment α1-β1.

Figure 11A:
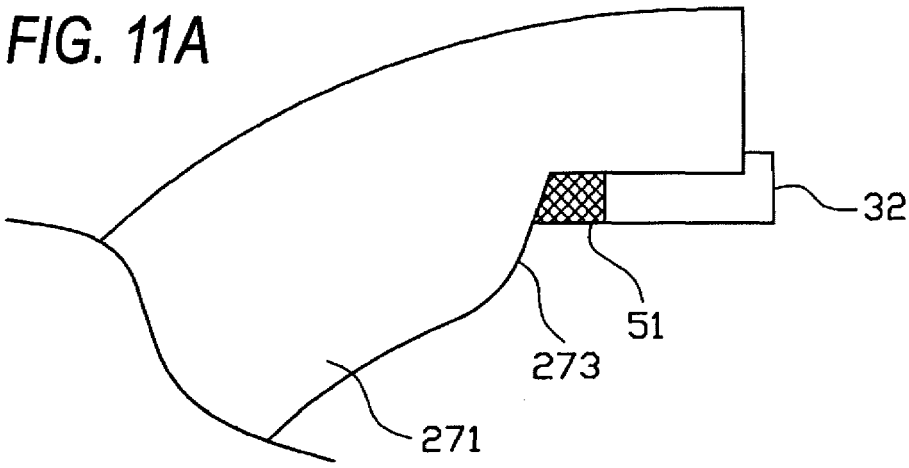
FIG. 11A to FIG. 11C are schematic side views of the ground electrode, etc., showing variation of the bulge portion in other embodiments.

Therefore, for example, as shown in FIG. 11A, when viewed from the side surface of the ground electrode 27, the surface of the bulge portion 51 on the base end side in the direction of the axis line (lower side surface in the figure) may be flush with the line segment α1-β1.

Figure 11B:
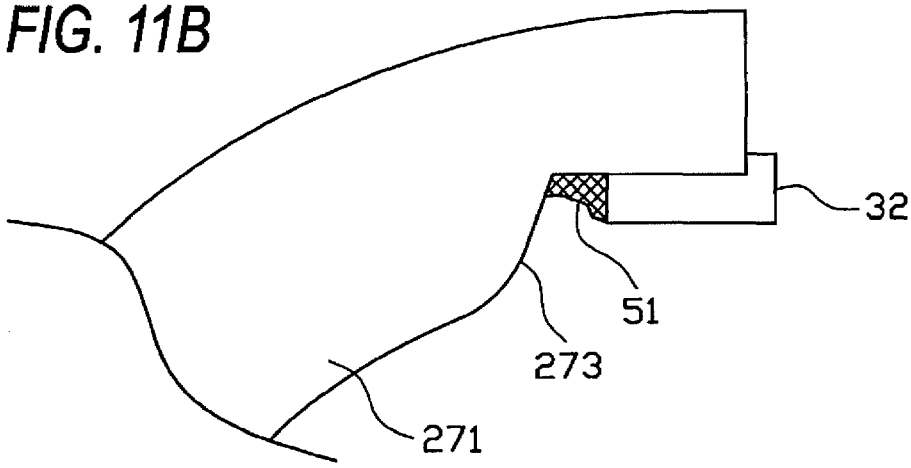

Further, as shown in FIG. 11B, when viewed from the side surface of the ground electrode 27, the surface of the bulge portion 51 on the base end side in the direction of the axis line may be concaved.

Figure 11C:
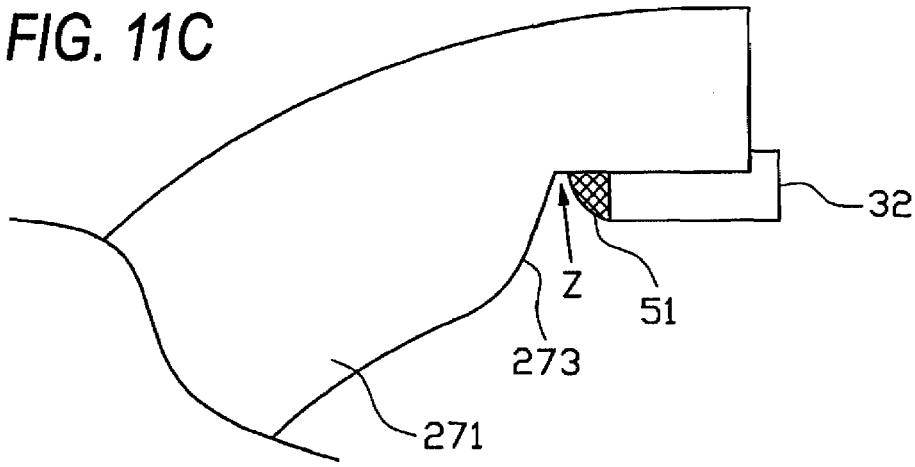

Further, for example, as shown in FIG. 11C, when viewed from the side surface of the ground electrode, a space Z may be formed between the stepped portion 273 and the bulge portion 51. In other words, the stepped portion 273 and the bulge portion 51 may not contact each other. The space Z between the stepped portion 273 and the bulge portion 51 can remarkably reduce the stress to be applied to the bulge portion 51 from the stepped portion 273 when bending the ground electrode 27. Therefore, the stress to be applied to the noble metal tip 32 from the bulge portion 51 is also reduced. As a result, deterioration in the peel resistance of the noble metal tip 32 due to the presence of the bulge portion 51 can be further prevented.

Figure 12:
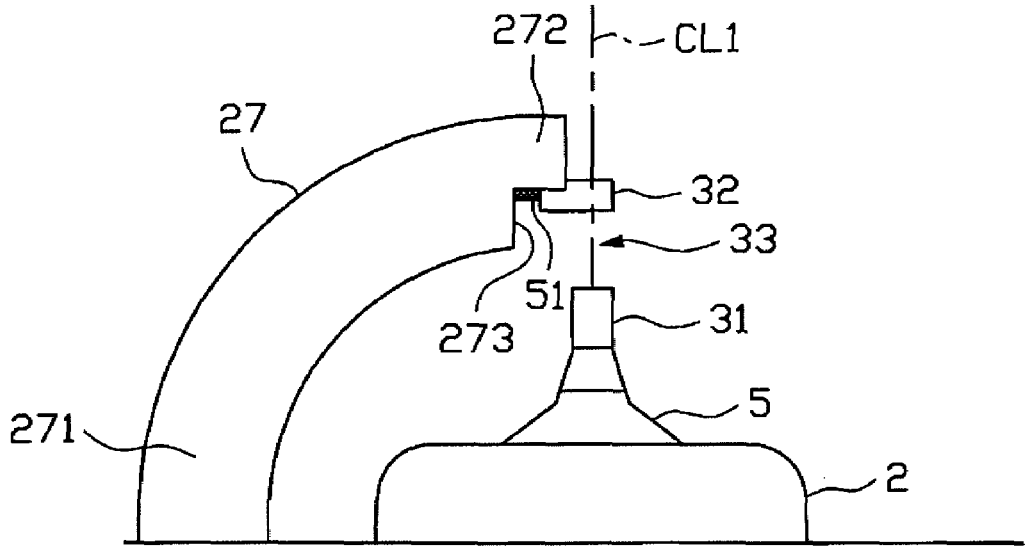
FIG. 12 is a schematic side view showing a major portion of a spark plug in another embodiment in an enlarged manner.

(g) In the above embodiment, the noble metal tip 32 protrudes toward the axis line CL1 from the distal end surface 27*s* of the ground electrode 27, and the spark discharge gap 33 is formed between the outer periphery of the noble metal tip 31 for the center electrode and the noble metal tip 32. In other words, in the above embodiment, the spark discharge is performed substantially along the direction perpendicular to the direction of the axis line CL1 (i.e., laterally). On the other hand, as shown in FIG. 12, the end face of the noble metal tip 32 in the direction of the axis line CL1 (lower end face in the figure) may be disposed to face the leading end surface of the noble metal tip 31 for the center electrode (or the leading end surface of the center electrode 5). In other words, the present invention may be embodied in a spark plug in which the spark discharge is performed substantially along the direction of the axis line CL1.

Figure 13:
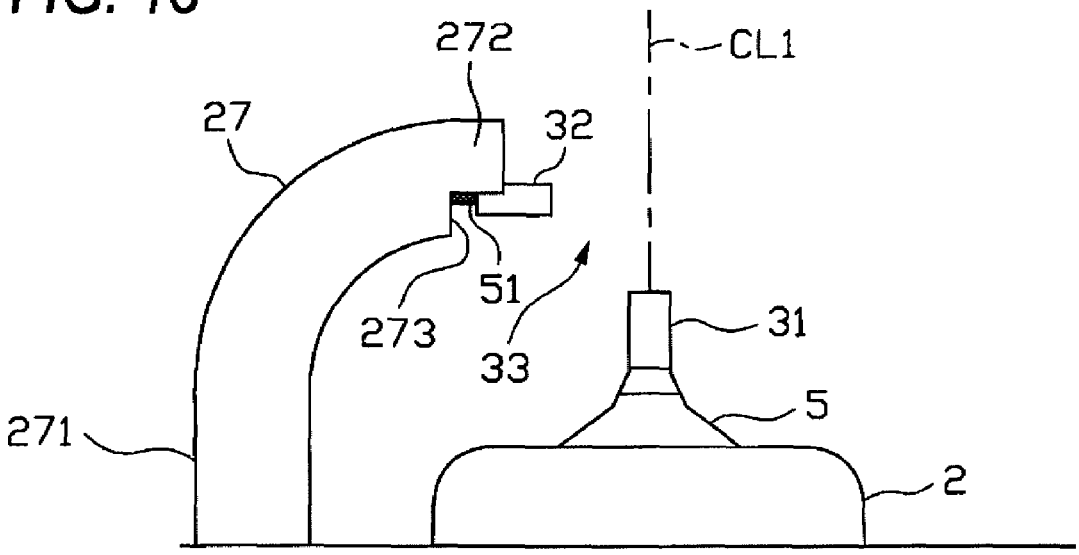
FIG. 13 is a schematic side view showing a major portion of a spark plug in another embodiment in an enlarged manner.

As shown in FIG. 13, the protruding end surface in the protruding direction of the noble metal tip 32 may also be disposed to face a part of the axis line CL1 located on the leading end side farther than the noble metal tip 31 for the center electrode. In other words, the present invention may be embodied in a spark plug in which the spark discharge is performed diagonally with respect to the direction of the axis line CL1.

(h) In the above embodiment, the relationship between the depth of the stepped portion 273 and the thickness of the noble metal tip 32 is not especially mentioned, however, it is more preferable that the depth of the stepped portion 273 is larger than the thickness of the noble metal tip 32. Accordingly, the thin portion 272 becomes thinner, and the residual stresses caused by bending at the thin portion 272 can be made smaller.

(i) If the thin portion 272 is excessively long, the advantages obtained by providing the thick portion 271 and the thin portion 272 may be reduced although this is not especially mentioned in the above-described embodiment. In such a perspective, the length from the distal end surface 27*s* of the ground electrode 27 to the stepped portion 273 (length of the thin portion 272) is preferably 1.2 (mm) or less.

This application is based on Japanese Patent Application No. 2007-300824 filed Nov. 20, 2007 and Japanese Patent application No. 2007-338716 filed on Dec. 28, 2007, the above applications incorporated herein by reference in their entirety.

What is claimed is:

1. A spark plug for an internal combustion engine, said spark plug comprising:

a rod-shaped center electrode extending in a direction of an axis line;

a substantially cylindrical insulator disposed on an outer periphery of the center electrode;

a cylindrical metal shell disposed on an outer periphery of the insulator;

a ground electrode having a base end joined to a leading end portion of the metal shell in the direction of the axis line and a distal end portion bent toward the axis line, said ground electrode comprising:

a thick portion provided on a base end side;

a thin portion provided on a distal end side; and a stepped portion provided on an inner peripheral surface between the thick portion and the thin portion;

a noble metal tip joined to and partially embedded in an inner peripheral surface of the thin portion, the noble metal tip being disposed to form a gap between the same and the leading end portion of the center electrode; and a bulge portion provided on the inner peripheral surface of the thin portion between the stepped portion and the noble metal tip and formed of substantially a same metal component contained in the ground electrode, wherein, when viewed from a side surface of the ground electrode, a following relationship is satisfied:

[a protruding height of the noble metal tip from the inner peripheral surface of the thin portion]≧[a protruding height of the bulge portion from the inner peripheral surface of the thin portion].

2. The spark plug according to claim 1, wherein when viewed from the side surface of the ground electrode, a space is formed between the stepped portion and the bulge portion.

3. The spark plug according to claim 1, wherein when viewed from the side surface of the ground electrode, the distance between an end portion of the noble metal tip located on the stepped portion side and the stepped portion in a direction perpendicular to the direction of the axis line is 0.1 mm or more.

4. The spark plug according to claim 1, wherein when viewed from the side surface of the ground electrode, the stepped portion has a straight portion, and wherein a relationship M1≦0.75 B is satisfied where:

a boundary point γ1 is an intersection of an extension line of the straight portion and an extension line of the inner peripheral surface of the thick portion, M1 (mm) is a distance between a distal end surface of the ground electrode and the boundary point γ1 in a direction perpendicular to the direction of the axis line, and B (mm) is a distance between the distal end surface of the ground electrode and the base end of the inner peripheral surface of the ground electrode in a direction perpendicular to the direction of the axis line.

5. The spark plug according to claim 1, wherein B/A≦2.5 is satisfied where, when viewed from the side surface of the ground electrode, A (mm) is a thickness of the thick portion of the ground electrode, and B (mm) is a distance between the distal end surface of the ground electrode and the base end of the inner peripheral surface of the ground electrode in a direction perpendicular to the direction of the axis line.

6. The spark plug according to claim 1, wherein 0.1≦E≦0.5 is satisfied where E (mm) is an amount of an embedded portion of the noble metal tip from the inner peripheral surface of the thin portion.

7. The spark plug according to claim 1, wherein the stepped portion and the thin portion are formed by cutting or pressing the distal end portion of the straight rod-shaped ground electrode, thereafter welding the noble metal tip to the distal end portion, and thereafter bending the ground electrode.

8. The spark plug according to claim 1, wherein the noble metal tip has a prism shape.

9. The spark plug according to claim 1, wherein a depth of the stepped portion is larger than a thickness of the noble metal tip.

10. The spark plug according to claim 1, wherein the noble metal tip protrudes from the distal end surface of the ground electrode, and wherein a protruding end surface in the protruding direction of the noble metal tip is disposed to face the leading end portion of the center electrode, to perform a spark discharge substantially along a direction perpendicular to the direction of the axis line.

11. The spark plug according to claim 1, wherein the noble metal tip protrudes from the distal end surface of the ground electrode, and wherein an end surface of the noble metal tip located at an end in the direction of the axis line is disposed to face the leading end portion of the center electrode to perform a spark discharge in a direction substantially along the direction of the axis line.

12. The spark plug according to claim 1, wherein the noble metal tip protrudes from the distal end surface of the ground electrode, and wherein the protruding end surface in the protruding direction of the noble metal tip is disposed to face a part of the axis line which is positioned in a leading end side farther than the center electrode to perform a spark discharge diagonally with respect to the direction of the axis line.

13. The spark plug according to claim 1, wherein the inner peripheral surface of the thin portion of the ground electrode has a flat surface perpendicular to the direction of the axis line.

14. A method for producing the spark plug according to claim 1, said method comprising:

forming the stepped portion and the thin portion by cutting or pressing the leading end portion of a straight rod-shaped ground electrode;

welding the noble metal tip to the inner peripheral surface of the thin portion to embedding a part of the noble metal tip in the inner peripheral surface of the thin portion; and bending the ground electrode to adjust the gap after said welding, wherein said forming the stepped portion and the thin portion, cutting or press is performed so that the stepped portion has a straight portion when viewed from the side surface of the ground electrode, and the welding step is performed so that following relationships are satisfied:

$$M2-N \geqq 0.3 \text{ (mm); and}$$

$$0.5 \text{ (mm)} \leqq N \leqq 1.5 \text{ (mm)}$$

where, when the ground electrode before being bent is viewed from the side surface, M2 (mm) is the distance between the distal end of the ground electrode and the thick portion, and N (mm) is the distance between the distal end of the ground electrode and the end portion of the noble metal tip located on the stepped portion side.

* * * * *